US007931468B2

(12) United States Patent
Ojiro et al.

(10) Patent No.: US 7,931,468 B2
(45) Date of Patent: Apr. 26, 2011

(54) ALL PRIMARY COMBUSTION BURNER

(75) Inventors: Takashi Ojiro, Nagoya (JP); Yoshihiko Takasu, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 330 days.

(21) Appl. No.: 11/946,375

(22) Filed: Nov. 28, 2007

(65) Prior Publication Data

US 2008/0131828 A1 Jun. 5, 2008

(30) Foreign Application Priority Data

Nov. 30, 2006 (JP) ..... 2006-324724
Aug. 9, 2007 (JP) ..... 2007-208529

(51) Int. Cl.
*F23D 14/62* (2006.01)

(52) U.S. Cl. ..... 431/354; 431/217; 431/350; 126/92 R

(58) Field of Classification Search ..... 431/7, 326, 431/328, 329, 278, 283, 351–354, 8–10, 431/116, 170, 171, 174, 177, 178, 181, 182, 431/185; 126/85 R, 92 R, 86, 87; 239/553, 239/553.3
See application file for complete search history.

(56) References Cited

U.S. PATENT DOCUMENTS 3,185,204 A * 5/1965 Loeb Petal. ..... 431/329
3,199,568 A * 8/1965 Baumanns et al. ..... 431/215
3,199,571 A * 8/1965 Koppel ..... 431/328
3,367,149 A * 2/1968 Manske ..... 431/328
3,547,097 A * 12/1970 Rice et al. ..... 126/4
4,927,355 A * 5/1990 Haire et al. ..... 431/329
5,240,409 A * 8/1993 Xiong ..... 431/189
5,292,244 A * 3/1994 Xiong ..... 431/189
5,423,675 A * 6/1995 Kratsch ..... 431/328
5,593,300 A * 1/1997 de Gouville ..... 431/328
6,659,765 B1 * 12/2003 Sen-Yu ..... 431/328

FOREIGN PATENT DOCUMENTS

JP 54100539 A * 8/1979
JP 2001-090913 4/2001
JP 2001090913 * 4/2001
JP 2001090913 A * 4/2001
JP 2004278809 A * 10/2004
JP 2009036464 A * 2/2009

* cited by examiner

*Primary Examiner* — Steven B McAllister
*Assistant Examiner* — Desmond Peyton
(74) *Attorney, Agent, or Firm* — Rankin, Hill & Clark LLP

(57) ABSTRACT

In an all primary combustion burner, a partition plate that demarcates a mixing chamber between the partition plate and a bottom wall section of a burner main body and a distributing plate that sections a space between the partition plate and the combustion plate into a first distributing chamber and a second distributing chamber are provided in the burner main body to cause a fuel gas and a primary air to flow into the mixing chamber A pressure loss is minimized to make it possible to satisfactorily mix the fuel gas and the primary air. An outlet is formed on a downstream side of the partition plate. A guide plate section that extends to the downstream side while inclining in a normal direction, which approaches the bottom wall section of the burner main body, from an edge on the upstream side of the outlet, is provided in the partition plate.

6 Claims, 5 Drawing Sheets

ALL PRIMARY COMBUSTION BURNER

BACKGROUND OF THE INVENTION

1. Field of the Invention

The present invention relates to an all primary combustion burner including a rectangular combustion plate in which a plurality of burner ports are formed and a burner main body of a box shape having an opening in which the combustion plate is inserted.

2. Description of the Related Art

Conventionally, among burners of this type, there is known a burner in which, with a longitudinal direction, a latitudinal direction, and a normal direction of a combustion plate set as an X axis direction, a Y axis direction, and a Z axis direction, respectively, a partition plate that demarcates a mixing chamber between the partition plate and a bottom wall section of a burner main body opposed to the combustion plate in the Z axis direction and a distributing plate that sections a space between the partition plate and the combustion plate into two chambers in the Z axis direction, i.e., a first distributing chamber on the partition plate side and a second distributing chamber on the combustion plate side, are provided in the burner main body. The burner mixes a fuel gas flowing into the mixing chamber from an upstream side in the X axis direction and a primary air in the mixing chamber to generate an air fuel mixture, guides the air fuel mixture from an outlet formed in the partition plate to the combustion plate through the first distributing chamber, a plurality of distributing holes formed in the distributing plate, and the second distributing chamber, and jets the air fuel mixture from burner ports of the combustion plate to subject the air fuel mixture to all primary combustion (see, for example, Japanese Patent Application Laid-Open No. 2001-90913).

In this burner, the outlet is formed in a slit shape long in the X axis direction and narrow in the Y axis direction. Consequently, an outflow of the air fuel mixture from the mixing chamber to the first distributing chamber is limited and the mixing of the fuel gas and the primary air in the mixing chamber is facilitated. However, a pressure loss in the outlet increases. Since the outlet is formed in the slit shape narrow in the Y axis direction, the air fuel mixture less easily flows to the portion of the first distributing chamber parting from the outlet in the Y axis direction. Therefore, to uniformalize the distribution of the air fuel mixture in the Y axis direction in the second distributing chamber, it is necessary to set an arrangement density of the distributing holes to be relatively low in the portion of the distributing plate located above the outlet. As a result, a pressure loss in the distributing plate also increases. To cope with the increase in the pressure loss in the outlet and the distributing plate, it is necessary to set a supply pressure of the primary air by a fan to be relatively high. As a result, noise increases.

SUMMARY OF THE INVENTION

The present invention has been devised in view of the problems and it is an object of the present invention to provide an all primary combustion burner that can reduce a pressure loss without spoiling the performance of mixing a fuel gas and a primary air and uniformity of the distribution of an air fuel mixture.

In order to attain the object, the present invention provides an all primary combustion burner including a rectangular combustion plate in which a plurality of burner ports are formed and a burner main body of a box shape having an opening in which the combustion plate is inserted. With a longitudinal direction, a latitudinal direction, and a normal direction of the combustion plate set as an X axis direction, a Y axis direction, and a Z axis direction, respectively, a partition plate that demarcates a mixing chamber between the partition plate and a bottom wall section of a burner main body opposed to the combustion plate in the Z axis direction and a distributing plate that sections a space between the partition plate and the combustion plate into two chambers in the Z axis direction, which is a first distributing chamber on the partition plate side and a second distributing chamber on the combustion plate side, are provided in the burner main body. The all primary combustion burner mixes a fuel gas flowing into the mixing chamber from an upstream side in the X axis direction and a primary air in the mixing chamber to generate an air fuel mixture, guides the air fuel mixture from an outlet formed in the partition plate to the combustion plate through the first distributing chamber, a plurality of distributing holes formed in the distributing plate, and the second distributing chamber, and jets the air fuel mixture from burner ports of the combustion plate to subject the air fuel mixture to all primary combustion. The outlet is formed widely in the Y axis direction in a portion on a downstream side in the X axis direction of the partition plate. A guide plate section that extends to the downstream side in the X axis direction while inclining in the Z axis direction, which approaches the bottom wall section of the burner main body, from an edge on the upstream side in the X axis direction of the outlet is provided in the partition plate.

According to the present invention, the air fuel mixture is guided by the guide plate section to temporarily flow away from the outlet in the Z axis direction and a flow of the air fuel mixture flowing toward the outlet by bypassing the guide plate section is generated. Consequently, a mixing distance is extended and a swirl is generated and the mixing of the fuel gas and the primary air is facilitated. Hence, even if the length in the X axis direction of the outlet is increased to set an opening area thereof to be relatively large, it is possible to satisfactorily mix the fuel gas and the primary air. Therefore, it is possible to reduce a pressure loss in the outlet without spoiling the performance of mixing the fuel gas and the primary air.

Since the outlet is wide in the Y axis direction, the distribution of the air fuel mixture in the Y axis direction in the first distributing chamber is uniform. Moreover, a motion component in the upstream side in the X axis direction is given to the air fuel mixture flowing to the outlet by bypassing the guide plate section by the inclination of the guide plate section. The air fuel mixture easily flows to the upstream side in the X axis direction in the first distributing chamber. Therefore, even if an arrangement density of the distributing holes in a portion on the downstream side in the X axis direction of the distributing plate (a portion above the outlet) is not set to be so low, the distribution of the air fuel mixture in the X axis direction and the Y axis direction in the second distributing chamber becomes uniform. Therefore, it is possible to reduce a pressure loss in the distributing plate. Eventually, it is possible to reduce a total pressure loss in the burner main body without spoiling the performance of mixing the fuel gas and the primary air and uniformity of the distribution of the air fuel mixture.

When an inclination angle in the Z axis direction with respect to the X axis direction of the guide plate section becomes smaller than 25°, it is impossible to facilitate the mixing of the fuel gas and the primary air enough. When the inclination angle becomes larger than 60°, the pressure loss increases because the guide plate section resists the flow of the air fuel mixture. Therefore, it is desirable that the inclination angle is set in a range of 25° to 60°.

When an extended length of the guide plate section is too short, the mixing performance is deteriorated. When the extended length is too long, the pressure loss increases. Therefore, it is desirable to set the extended length of the guide plate section such that a ratio of the extended length to the length in the X axis direction of the outlet is in a range of 0.2 to 0.4.

In the present invention, it is desirable that a space is secured between an outer side edge in the Y axis direction of the guide plate section and a sidewall surface of the mixing chamber. Consequently, a flow of the air fuel mixture flowing toward the outlet by bypassing the outer side portion in the Y axis direction of the guide plate section is generated, whereby a swirl is generated. Therefore, the mixing of the fuel gas and the primary air is further facilitated.

In the present invention, it is desirable that the guide plate section is formed by cutting and raising the partition plate in the outlet. Although it is possible to form the guide plate section using a separate plate material attached to the partition plate, this increases the number of components and cost. On the other hand, if the guide plate section is formed by cutting and raising the partition plate, since the number of components does not increase, this is advantageous in realizing a reduction in cost.

The air fuel mixture having passed an opening portion closer to the edge on the downstream side in the X axis direction of the outlet tends to flow straight in the Z axis direction toward the distributing plate. In this state, since a mixing distance is short, the air fuel mixture not sufficiently mixed tends to jet from a portion on the downstream side in the X axis direction of the combustion plate. Therefore, in the present invention, it is desirable that a first baffle plate that prevents the air fuel mixture having passed the opening portion closer to the edge on the downstream side in the X axis direction of the outlet from flowing straight in the Z axis direction toward the distributing plate is provided. Consequently, the air fuel mixture having passed the opening portion closer to the edge on the downstream side in the X axis direction of the outlet flows by bypassing the first baffle plate and the mixing distance is extended. Therefore, it is possible to prevent the insufficiently mixed air fuel mixture from jetting from the portion on the downstream side in the X axis direction of the combustion plate.

It is desirable that the first baffle plate projects to curve to the upstream side in the X axis direction in a projection space in the Z axis direction, which projects to the distributing plate side of the opening portion closer to the edge on the downstream side in the X axis direction of the outlet, while approaching the distributing plate from the downstream side in the X axis direction of the projection space. Consequently, it is possible to control an increase in a pressure loss due to the first baffle plate.

When the height in the Z axis direction from the partition plate to the tip of the first baffle plate becomes smaller than 85% of the dimension in the Z axis direction of the first distributing chamber, an outflow resistance of the air fuel mixture from the outlet increases. When the height in the Z axis direction becomes larger than 90% of the dimension in the Z axis direction of the first distributing chamber, since invasion of the air fuel mixture to a portion of the first distributing chamber further on the downstream side in the X axis direction than the first baffle plate is excessively controlled, insufficiency of the distribution of the air fuel mixture to the end on the downstream side in the X axis direction of the combustion plate tends to occur. Therefore, it is desirable that the height in the Z axis direction from the partition plate to a tip of the first baffle plate is 85% to 90% of the dimension in the Z axis direction of the first distributing chamber.

When the first baffle plate is provided, a motion component toward the upstream side in the X axis direction is given to the air fuel mixture flowing into the first distributing chamber from the outlet not only by the guide plate section but also by the first baffle plate. In this state, the distribution of the air fuel mixture to an end on the upstream side in the X axis direction of the first distributing chamber becomes excessively large and a jetting pressure of the air fuel mixture at an end on the upstream side in the X axis direction of the combustion plate becomes excessively high. Therefore, when the first baffle plate is provided, it is desirable to provide a second baffle plate that prevents the air fuel mixture from flowing straight in the X axis direction toward the end on the upstream side in the X axis direction of the first distributing chamber. Consequently, since the distribution of the air fuel mixture to the end on the upstream side in the X axis direction of the first distributing chamber does not become excessively large, it is possible to prevent the jetting pressure of the air fuel mixture at the end on the upstream side in the X axis direction of the combustion plate from becoming excessively high.

It is desirable that the second baffle plate has an inclined plate section that extends to the upstream side in the X axis direction while inclining in the Z axis direction approaching the distributing plate from an edge on the upstream side in the X axis direction of the outlet and a rising section that rises while curving in the Z axis direction from a tip of the inclined plate section to the distributing plate. Consequently, it is possible to smoothly give a motion component to the distributing plate side to the air fuel mixture flowing from the outlet to the upstream side in the X axis direction and it is possible to control an increase in a pressure loss due to the second baffle plate.

When a space width in the Z axis direction between the tip of the rising section of the second baffle plate and the distributing plate becomes smaller than 10% of the dimension in the Z axis direction of the first distributing chamber, the distribution of the air fuel mixture to the end on the upstream side in the X axis direction of the first distributing chamber is excessively limited. When the gap width becomes larger than 15% of the dimension in the Z axis direction of the first distributing chamber, the distribution of the air fuel mixture to the end on the upstream side in the X axis direction of the first distributing chamber becomes excessively large. Therefore, it is desirable that the gap width in the Z axis direction between a tip of the rising section of the second baffle plate and the distributing plate is 10% to 15% of the dimension in the Z axis direction of the first distributing chamber.

DETAILED DESCRIPTION OF THE PREFERRED EMBODIMENTS

Figure 1:
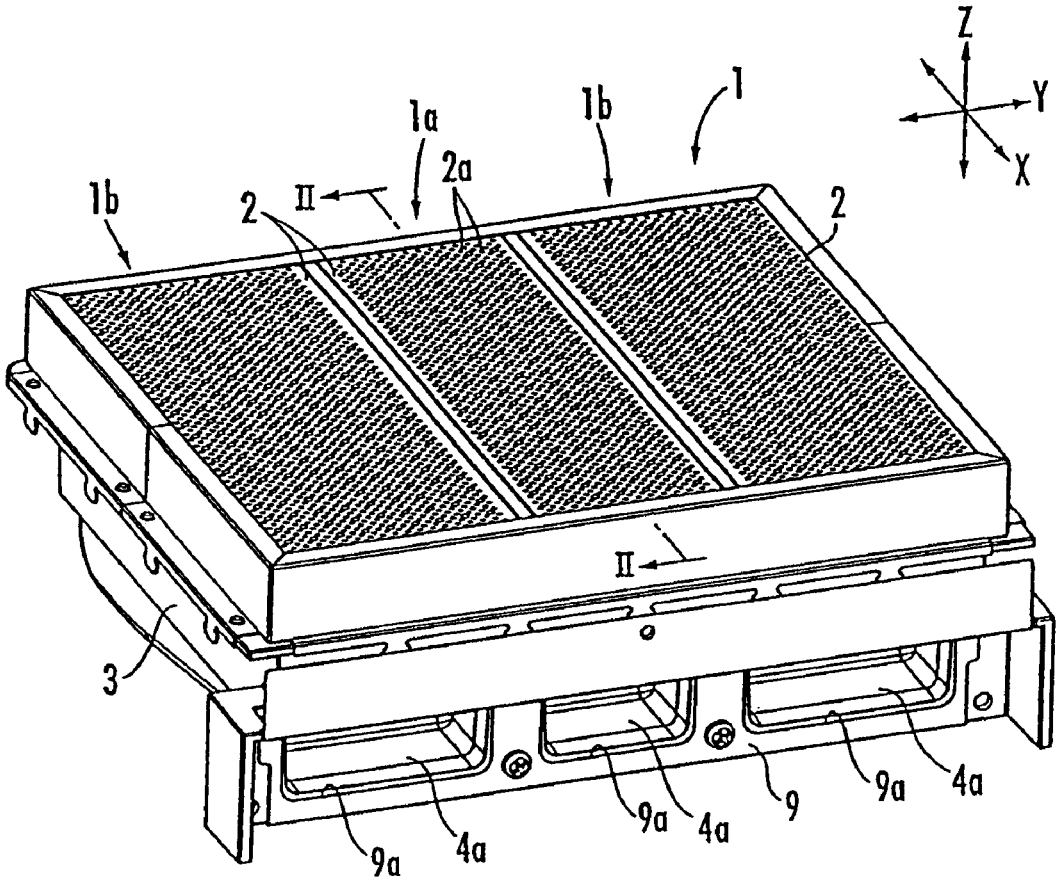
FIG. 1 is a perspective view of a burner according to a first embodiment of the present invention.

Referring to FIG. 1, reference numeral 1 denotes an all primary combustion burner according to an embodiment of the present invention. The burner 1 includes a smaller burner section 1*a* and a pair of large burner sections 1*b* on both sides of the small burner section 1*a*.

Each of the burner sections 1*a* and 1*b* includes a rectangular combustion plate 2 made of ceramic in which a plurality of burner ports 2*a* are formed and a burner main body 3 of a box shape having an opening in which the combustion plate 2 is inserted. The structure of the burner will be explained in detail below with a longitudinal direction, a latitudinal direction, and a normal direction of the combustion plate 2 set as an X axis direction, a Y axis direction, and a Z axis direction, respectively. The burner main body 3 of each of the burner sections 1*a* and 1*b* is integrated with the burner main body 3 of the burner section adjacent thereto in sidewall sections of first and second distributing chambers 6 and 7 described later.

Figure 2:
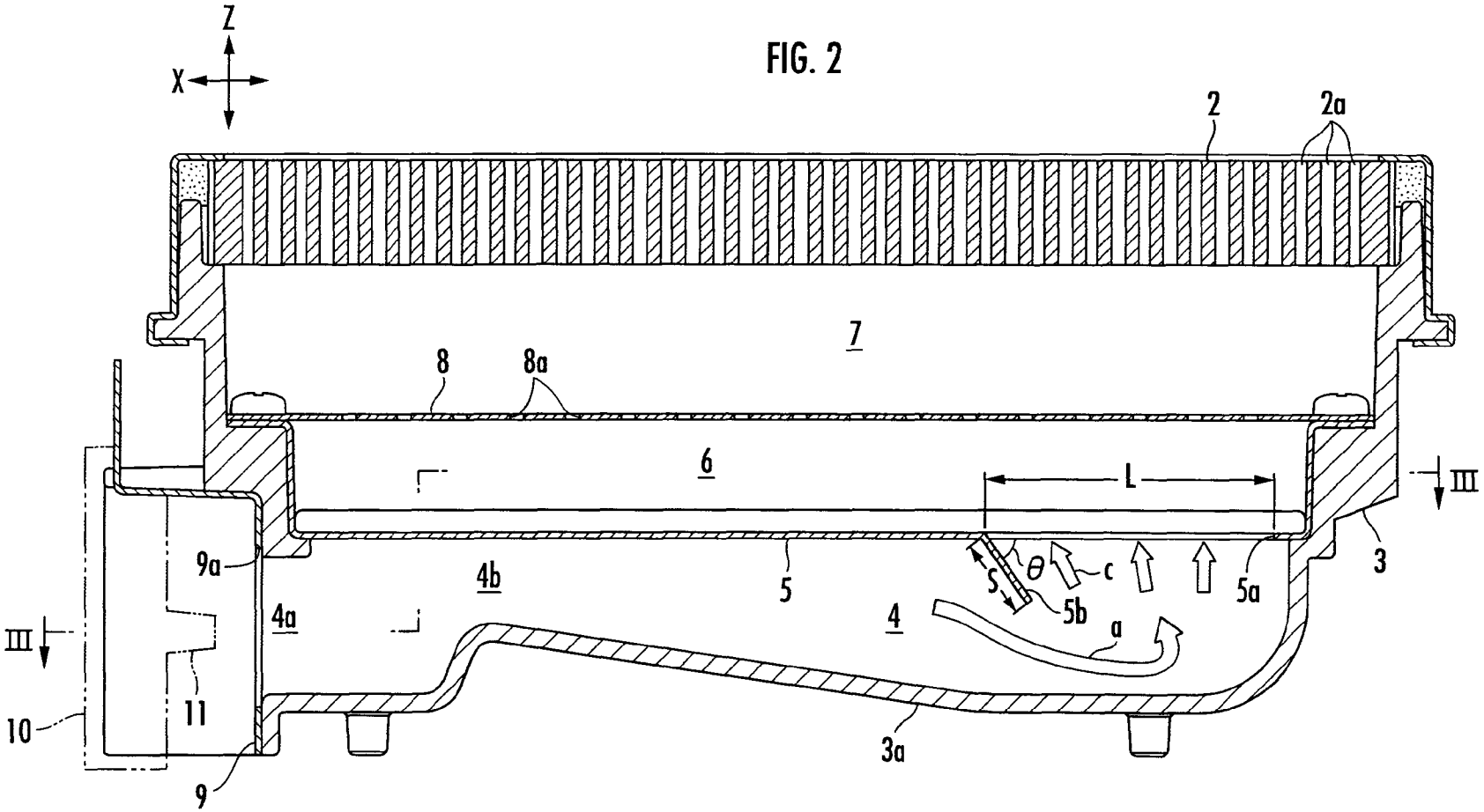
FIG. 2 is a sectional side view taken along line II-II in FIG. 1.

In the burner main body 3, as shown in FIG. 2, a partition plate 5 that demarcates a mixing chamber 4 between the partition plate 5 and a bottom wall section 3*a* of the burner main body 3 opposed to the combustion plate 2 in the Z axis direction and a distributing plate 8 that sections a space between the partition plate 5 and the combustion plate 2 into two chambers in the Z axis direction, i.e., a first distributing chamber 6 on the partition plate 5 side and a second distributing chamber 7 on the combustion plate 2 side are provided.

An end on the upstream side in the X axis direction (the left side in FIG. 2) of the mixing chamber 4 communicates with an inlet 4*a* opened in an end face on the upstream side in the X axis direction of the burner main body 3. A Venturi section 4*b* located near the inlet 4*a* and reduced in the width in the Z axis direction is provided in the mixing chamber 4. A damper 9 in which a damper hole 9*a* facing the inlet 4*a* is formed is attached to an end face on the upstream side in the X axis direction of the burner main body 3. A gas manifold 10 opposed to the end face on the upstream side in the X axis direction of the burner main body 3 is provided and a primary air chamber to which the air from a not-shown fan is supplied is demarcated between the gas manifold 10 and the burner main body 3.

Figure 3:
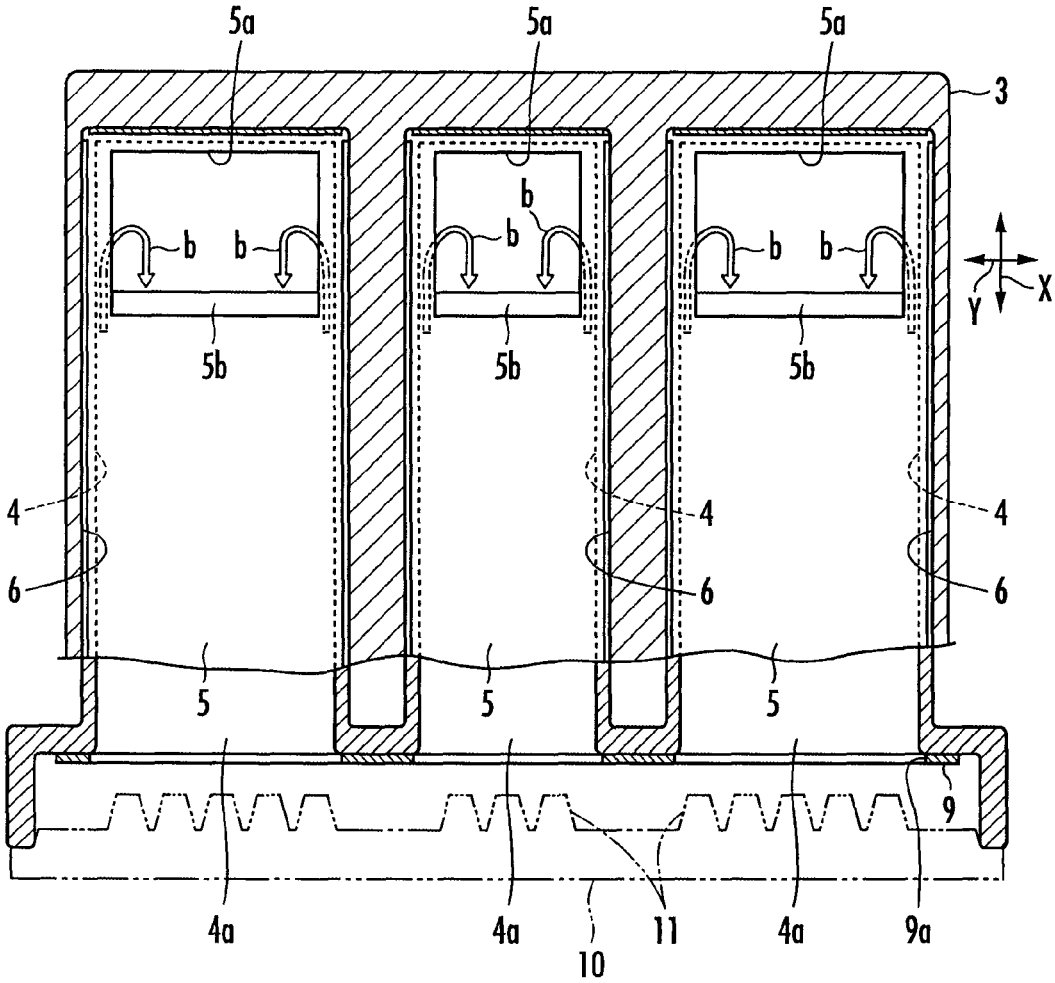
FIG. 3 is a sectional plan view taken along line III-III in FIG. 2.

In the gas manifold 10, as shown in FIG. 3, three gas nozzles 11 are provided in parallel in the Y axis direction to face the inlet 4*a* of the mixing chamber 4 of the small burner section 1*a* and five gas nozzles 11 are provided in parallel in the Y axis direction to face the inlet 4*a* of the mixing chamber 4 of each of the large burner section 1*b*. In this way, a primary air flows into the mixing chamber 4 of each of the burner sections 1*a* and 1*b* from the upstream side in the X axis direction and a fuel gas from the plural gas nozzles 11 flows into the mixing chamber 4. The fuel gas and the primary air are mixed in each of the mixing chambers 4 and an air fuel mixture having a fuel density lower than a theoretical air fuel ratio is generated.

An outlet 5*a* wide in the Y axis direction is formed in a portion on the downstream side in the X axis direction of the partition plate 5. The width in the Y axis direction of the outlet 5*a* is slightly smaller than the width in the Y axis direction of the mixing chamber 4. A plurality of distributing holes 8*a* are formed in the distributing plate 8. The air fuel mixture generated in the mixing chamber 4 is guided from the outlet 5*a* to the combustion plate 2 through the first distributing chamber 6, the distributing holes 8*a*, and the second distributing chamber 7 and jets from the burner ports 2*a* of each of the combustion plates 2 to be subjected to all primary combustion.

To perform satisfactory combustion over the entire area of the combustion plate 2, it is necessary to evenly mix the fuel gas and the primary air in the mixing chamber 4 and uniformalize the distribution in the X axis direction and the Y axis direction of the air fuel mixture in the second distributing chamber 7. To lower a supply pressure of the primary air by the fan and reduce noise, it is necessary to reduce a pressure loss in the burner main body 3.

Therefore, in this embodiment, a guide plate section 5*b* that extends to the downstream side in the X axis direction while inclining in the Z axis direction, which approaches the bottom wall section 3*a* of the burner main body 3, from an edge on the upstream side in the X axis direction of the outlet 5*a* is provided in the partition plate 5. The guide plate section 5*b* is formed integrally with the partition plate 5 by cutting and raising the partition plate 5 in the outlet 5*a*.

With the structure described above, as indicated by an arrow "a" in FIG. 2, the air fuel mixture is guided by the guide plate section 5*b* to temporarily flow away from the outlet 5*a* in the Z axis direction and a flow of the air fuel mixture flowing toward the outlet 5*a* by bypassing the guide plate section 5*b* in the Z axis direction is generated. Consequently, a mixing distance is extended and a swirl is generated. The mixing of the fuel gas and the primary air is facilitated.

It is also possible to provide the guide plate section 5*b* over the entire width in the Y axis direction of the mixing chamber 4. However, in this embodiment, a space between the guide plate section 5*b* and a sidewall surface of the mixing chamber 4 is secured in an outer side portion in the Y axis direction of the guide plate section 5*b*. As a result, as indicated by an arrow "b" in FIG. 3, a flow of the air fuel mixture flowing to the outlet 5*a* by bypassing the outer side portion in the Y axis direction of the guide plate section 5*b* is also generated, whereby a swirl is generated. Therefore, the mixing of the fuel gas and the primary air is further facilitated.

When the guide plate section 5*b* is not provided, to improve the mixing of the fuel gas and the primary air, it is necessary to reduce the length in the X axis direction of the outlet 5*a* to reduce an opening area thereof and limit the outflow of the air fuel mixture from the outlet 5*a*. For example, when the length in the X axis direction of the mixing chamber 4 is about 130 mm, when the guide plate section 5*b* is not provided, it is necessary to set length L in the X axis direction of the outlet 5*a* to be equal to or smaller than 26 mm to obtain predetermined performance of mixing the fuel gas and the primary air. On the other hand, when the guide plate section 5*b* is provided as in this embodiment, even if the length L in the X axis direction of the outlet 5*a* is set to 36 mm, mixing performance same as that at the time when the length L is set to 26 mm is obtained. Therefore, according to this embodiment, the performance of mixing the fuel gas and the primary air is not spoiled even if the opening area of the outlet 5*a* is relatively large. It is possible to reduce a pressure loss in the outlet 5*a* by increasing the opening area of the outlet 5*a*.

In this embodiment, since the outlet 5*a* is wide in the Y axis direction, the distribution in the Y axis direction of the air fuel mixture in the first distributing chamber 6 is uniformalized. Moreover, as indicated by an arrow "c" in FIG. 2, a motion component to the upstream side in the X axis direction is given to the air fuel mixture flowing toward the outlet 5*a* by bypassing the guide plate section 5*b* by the inclination of the guide plate section 5*b*. Accordingly, the air fuel mixture easily flows to the upstream side in the X axis direction in the first distributing chamber 6. Therefore, even if an arrangement density of the distributing holes 8*a* in a portion on the downstream side in the X axis direction (a portion opposed to the outlet 5*a*) of the distributing plate 8 is not set to be so low, the distribution in the X axis direction and the Y axis direction of the air fuel mixture in the second distributing chamber 7 is uniformalized. Therefore, it is possible to also reduce a pressure loss in the distributing plate 8. Eventually, it is possible to reduce a total pressure loss in the burner main body 3 without spoiling the performance of mixing the fuel gas and the primary air and uniformity of the distribution of the air fuel mixture. Consequently, since satisfactory combustion is performed over the entire area of the combustion plate 2, it is possible to lower a supply pressure of the primary air by the fan and reduce noise.

When an inclination angle θ in the Z axis direction with respect to the X axis direction of the guide plate section 5*b* becomes smaller than 25°, it is impossible to facilitate the mixing of the fuel gas and the primary air enough. On the other hand, when the inclination angle θ becomes larger than 60°, a pressure loss increases because the guide plate section 5*b* resists the flow of the air fuel mixture. Therefore, it is desirable that the inclination angle θ is set in a range of 25° to 60°. In this embodiment, the inclination angle θ is 57°.

When the extended length S of the guide plate section 5*b* is too short, the mixing performance is deteriorated. When the extended length S is too long, the pressure loss increases. Therefore, it is desirable to set the extended length S of the guide plate section 5*b* such that a ratio of the extended length S to the length L in the X axis direction of the outlet 5*a* (S/L) is in a range of 0.2 to 0.4. For example, when the length L is 36 mm, the extended length S is set to 10 mm such that S/L is about 0.28.

Figure 4:
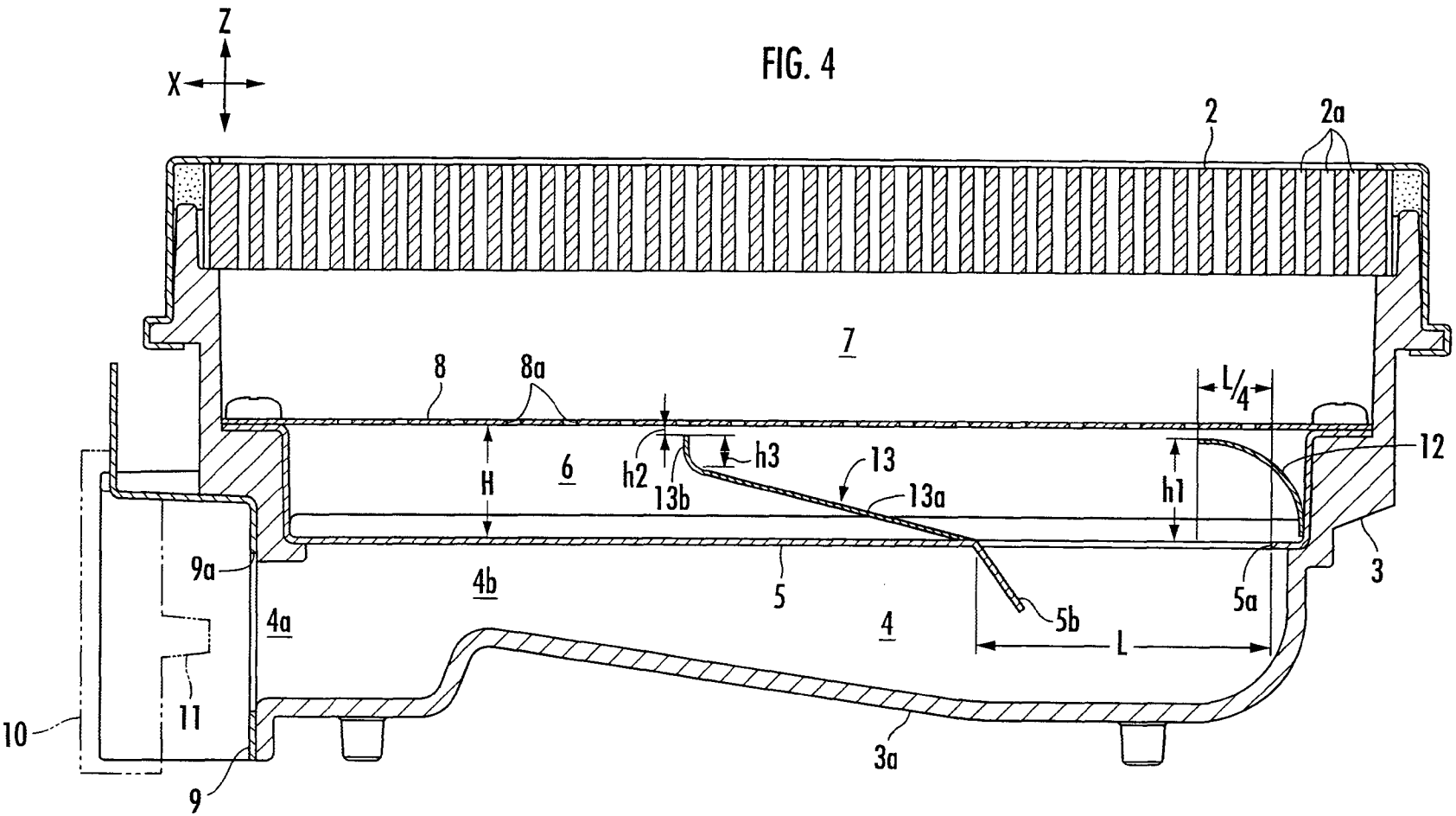
FIG. 4 is a sectional side view of a burner according to a second embodiment of the present invention corresponding to FIG. 2.

An all primary combustion burner according to a second embodiment of the present invention shown in FIG. 4 will be explained. A basic structure of the all primary combustion burner according to the second embodiment is identical with that of the all primary combustion burner according to the first embodiment. Members and sections same as those in the first embodiment are denoted by the same reference numerals and signs. The second embodiment is different from the first embodiment in that a first baffle plate 12 that prevents the air fuel mixture having passed an opening portion closer to the edge on the downstream side in the X axis direction of the outlet 5*a* from flowing straight in the Z axis direction toward the distributing plate 8 is provided and a second baffle plate 13 that prevents the air fuel mixture from flowing straight in the X axis direction toward the end on the upstream side in the X axis direction of the first distributing chamber 6 is provided.

The first baffle plate 12 projects to curve to the upstream side in the X axis direction in a projection space in the Z axis direction, which projects to the distributing plate 8 side of the opening portion closer to the edge on the downstream side in the X axis direction of the outlet 5*a* (e.g., a portion in a range of ¼ of the length L in the X axis direction of the outlet 5*a* from the edge on the downstream side in the X axis direction of the outlet 5*a*), while approaching the distributing plate 8 from the downstream side in the X axis direction of the projection space. It is also possible to project the first baffle plate 12 in the projection space in parallel to the X axis. However, if the first baffle plate 12 is curved as in the second embodiment, since the air fuel mixture smoothly flows along the first baffle plate 12, it is possible to control an increase in a pressure loss due to the first baffle plate 12.

In the second embodiment, the first baffle plate 12 is separate from the partition plate 5 and a base end of the first baffle plate 12 is fixed to an end face on the downstream side in the X axis direction of the first distributing chamber 6. However, as in the guide plate section 5*b*, it is also possible to form the first baffle plate 12 integrally with the partition plate 5 by cutting and raising the partition plate 5 in the outlet 5*a*. Moreover, a plurality of small holes may be formed in the first baffle plate 12.

Figure 5:
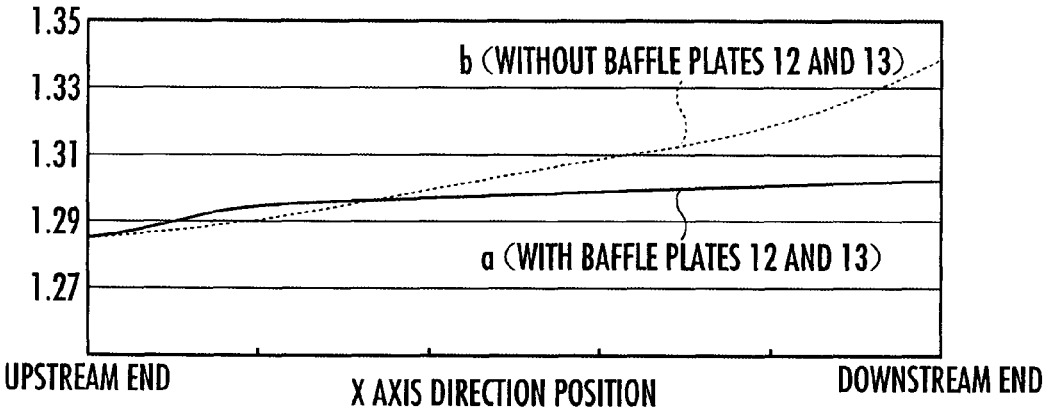
FIG. 5 is a graph showing a result of measurement of excess air factors of an air fuel mixture that is jetted from respective portions of a combustion plate of the burner according to the first embodiment and a combustion plate of the burner according to the second embodiment.

An experiment for measuring an excess air factor λ of the air fuel mixture jetting from respective portions of the combustion plate 2 was performed using the burner according to the first embodiment and the burner according to the second embodiment with a supply quantity of the primary air from the inlet 4*a* set such that the excess air factor λ (=supplied air quantity/theoretical air quantity) is 1.30. Line "a" in FIG. 5 indicates a result of measurement in the burner according to the second embodiment and line "b" in the figure indicates a result of measurement in the burner according to the first embodiment. In the burner according to the first embodiment, the excess air factor λ gradually increases from the middle in the X axis direction of the combustion plate 2 to the downstream side. At the end on the downstream side in the X axis direction of the combustion plate 2, the excess air factor λ is as large as 1.34. This is because the air fuel mixture having passed through the opening closer to the edge on the downstream side in the X axis direction of the outlet 5*a* flows straight in the Z axis direction toward the distributing plate 8, a mixing distance to the combustion plate 2 is reduced, and the air fuel mixture jets in an insufficient mixture state from a portion on the downstream side in the X axis direction of the combustion plate 2.

On the other hand, in the burner according to the second embodiment, the excess air factor λ is about 1.30 from the middle in the X axis direction to the end on the downstream side in the X axis direction of the combustion plate 2. This is because, since the air fuel mixture having passed the opening closer to the edge on the downstream side in the X axis direction of the outlet 5*a* flows by bypassing the first baffle plate 12, the mixing distance to the combustion plate 2 is extended and the mixing of the air fuel mixture jetting from the portion on the downstream side in the X axis direction of the combustion plate 2 is facilitated.

When height h1 in the Z axis direction from the partition plate 5 to the end of the first baffle plate 12 is smaller than 85% of dimension H in the Z axis direction of the first distributing chamber, a resistance of outflow of the air fuel mixture from the outlet 5*a* increases. When the height h1 in the Z axis direction becomes larger than 90% of the dimension H in the Z axis direction of the first distributing chamber 6, invasion of the air fuel mixture to the portion of the first distributing chamber 6 further on the downstream side in the X axis direction than the first baffle plate 12 is excessively controlled. Thus, insufficiency of the distribution of the air fuel mixture to the end on the downstream side in the X axis direction of the combustion plate 2 tends to occur. Therefore, it is desirable that the height h1 in the Z axis direction from the partition plate 5 to the end of the first baffle plate 12 is 85% to 90% of the dimension H in the Z axis direction of the first distributing chamber 6. For example, when the dimension H is 15 mm, the height h1 is set to 13 mm such that h1/H is about 0.87.

Figure 6:
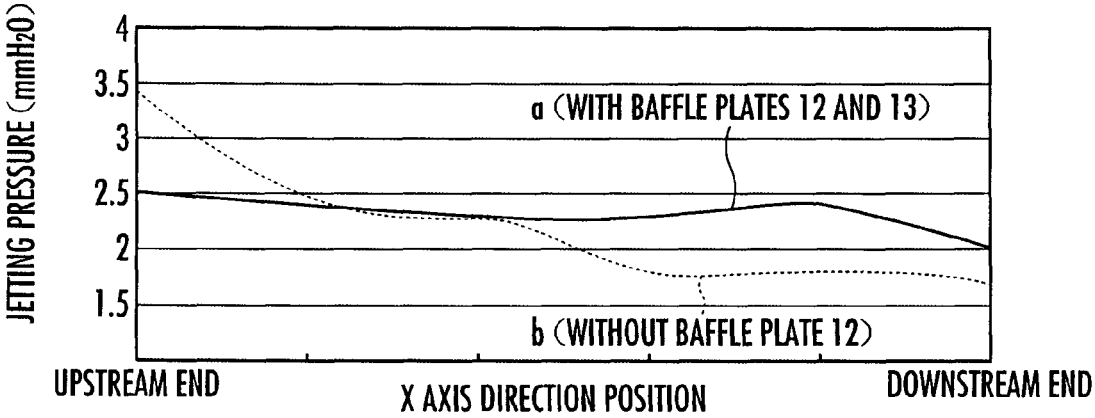
FIG. 6 is a graph showing a result of measurement of jetting pressures of the air fuel mixture in the respective portions of the combustion plate of the burner according to the second embodiment and a combustion plate of a burner not including a second baffle plate.

An experiment for measuring a jetting pressure of the air fuel mixture in respective portions of the combustion plate 2 was performed using the burner according to the second embodiment including both the first and second baffle plates 12 and 13 and a burner including the first baffle plate 12 but not including the second baffle plate 13. Line "a" in FIG. 6 indicates a result of measurement in the burner according to the second embodiment and line "b" in the figure indicates a result of measurement in the burner including only the first baffle plate 12.

In the burner including only the first baffle plate 12, a jetting pressure of the air fuel mixture is excessively high at the end on the upstream side in the X axis direction of the combustion plate 2. This is because, since a motion component to the upstream side in the X axis direction is given to the air fuel mixture flowing into the first distributing chamber 6 from the outlet 5*a* not only by the guide plate section 5*b* but also by the first baffle plate 12, the distribution of the air fuel mixture to the end on the upstream side in the X axis direction of the first distributing chamber 6 is excessively large. Since the air fuel mixture jetting from the center area of the combustion plate 2 receives heat from the combustion plate 2, even if the jetting pressure of the air fuel mixture is high, the air fuel mixture stably burns without lifting. However, when the jetting pressure of the air fuel mixture rises at the end area of the combustion plate 2, flames lift and a combustion state becomes unstable. In the burner including only the first baffle plate 12, since the distribution of the air fuel mixture to the end on the upstream side in the X axis direction of the first distributing chamber 6 becomes excessively large, the jetting pressure of the air fuel mixture falls in the portion on the downstream side in the X axis direction of the combustion plate 2.

On the other hand, in the burner according to the second embodiment, since it is possible to prevent, with the second baffle plate 13, the air fuel mixture from flowing straight in the X axis direction toward the end on the upstream side of the first distributing chamber 6, the distribution of the air fuel mixture to the end on the upstream side in the X axis direction of the first distributing chamber 6 does not become excessively large. Therefore, it is possible to prevent the jetting pressure of the air fuel mixture from becoming excessively high at the end on the upstream side in the X axis direction of the combustion plate 2. Moreover, it is also possible to prevent the jetting pressure of the air fuel mixture from falling in the portion on the downstream side in the X axis direction of the combustion plate 2.

It is also conceivable to provide a second baffle plate to stand in the Z axis direction from the partition plate 5 in the middle position between the edge on the upstream side in the X axis direction of the outlet 5*a* and the end on the upstream side in the X axis direction of the first distributing chamber 6. However, since the air fuel mixture collides with the second baffle plate, a pressure loss increases. Thus, in the second embodiment, the second baffle plate 13 is formed in a shape having an inclined plate section 13*a* that extends to the upstream side in the X axis direction while inclining in the Z axis direction approaching the distributing plate 8 from the edge on the upstream side in the X axis direction of the outlet 5*a* and a rising section 13*b* that rises while curving in the Z axis direction from a tip of the inclined plate section 13*a* toward the distributing plate 8. Consequently, it is possible to smoothly give a motion component to the distributing plate 8 side to the air fuel mixture flowing from the outlet 5*a* to the upstream side in the X axis direction and it is possible to control an increase in a pressure loss due to the second baffle plate 13.

When width h2 of a space in the Z axis direction between a tip of the rising section 13*b* of the second baffle plate 13 and the distributing plate 8 becomes smaller than 10% of the dimension H in the Z axis direction of the first distributing chamber 6, the distribution of the air fuel mixture to the end on the upstream side in the X axis direction of the first distributing chamber 6 is excessively limited. When the width h2 of the space becomes larger than 15% of the dimension H in the Z axis direction of the first distributing chamber, the distribution of the air fuel mixture to the end on the upstream side in the X axis direction of the first distributing chamber 6 becomes excessively large. Therefore, it is desirable that the width h2 of the space is 10% to 15% of the dimension H in the Z axis direction of the first distributing chamber 6. For example, when the dimension H is 15 mm, the width h2 is set to 2 mm such that h2/H is about 0.13.

It is desirable that dimension h3 in the Z axis direction of the rising section 13*b* (the height in the Z axis direction from an intersection of a line in the Z axis direction including the rising section 13*b* and an extended line of the inclined section 13*a* to the tip of the rising section 13*b*) is set to 4 mm to 5 mm in giving a motion component in the Z axis direction to the air fuel mixture. It is desirable that the position in the X axis direction of the rising section 13*b* is set such that a distance in the X axis direction between the end face on the upstream side in the X axis direction of the first distributing chamber 6 and the rising section 13*b* is ¼ to ½ of the length in the X axis direction of the first distributing chamber 6.

The embodiments of the present invention have been explained with reference to the drawings. However, the present invention is not limited to the embodiments. For example, in the embodiments, the fuel gas and the primary air are caused to flow into the mixing chamber 4 from the inlet 4*a* opened on the end face on the upstream side in the X axis direction of the burner main body 3. However, a gas nozzle may be fit on the end face on the upstream side in the X axis direction of the burner main body 3 to cause the primary air to flow in from an inlet opened at the end on the upstream side in the X axis direction of the bottom wall section 3*a* of the burner main body 3.

In the embodiments, the guide plate section 5*b* is formed integrally with the partition plate 5 by cutting and raising the partition plate 5. However, it is also possible to form the guide plate section 5*b* using a separate plate material attached to the partition plate 5. However, since the number of components increases and cost increases, the embodiments in which the guide plate section 5*b* is formed integrally with the partition plate 5 are more advantageous in realizing a reduction in cost.

What is claimed is:

1. An all primary combustion burner, comprising:

a rectangular combustion plate in which a plurality of burner ports are formed; and a burner main body of a box shape having an opening in which the combustion plate is inserted, with a longitudinal direction, a latitudinal direction, and a normal direction of the combustion plate set as an X axis direction, a Y axis direction, and a Z axis direction, respectively, a partition plate that demarcates a mixing chamber between the partition plate and a bottom wall section of a burner main body opposed to the combustion plate in the Z axis direction and a distributing plate that sections a space between the partition plate and the combustion plate into two chambers in the Z axis direction, which is a first distributing chamber on the partition plate side and a second distributing chamber on the combustion plate side, being provided in the burner main body, the all primary combustion burner mixing a fuel gas flowing into the mixing chamber from an upstream side in the X axis direction and a primary air in the mixing chamber to generate an air fuel mixture, guiding the air fuel mixture from an outlet formed in the partition plate to the combustion plate through the first distributing chamber, a plurality of distributing holes formed in the distributing plate, and the second distributing chamber, and jetting the air fuel mixture from burner ports of the combustion plate to subject the air fuel mixture to all primary combustion, wherein the outlet is formed widely in the Y axis direction in a portion on a downstream side in the X axis direction of the partition plate, and a guide plate section is provided by the partition plate, said guide plate section extending from an upstream edge of the outlet, toward a downstream edge of the outlet, where said upstream edge is disposed on an upstream side in the X axis direction of the outlet and said downstream edge is disposed on a downstream side in the X axis direction of the outlet, where the guide plate section is angled in the Z axis direction relative to the partition plate and the outlet, such that the guide plate section extends from the upstream edge of the outlet toward the bottom wall section of the burner main body, wherein a first baffle plate that prevents the air fuel mixture having passed the opening portion closer to the edge on the downstream side in the X axis direction of the outlet from flowing straight in the Z axis direction toward the distributing plate is provided, wherein the first baffle plate includes a base end that is secured to the burner main body.

2. The all primary combustion burner according to claim 1, wherein the first baffle plate has an arcuate shape and projects to curve to the upstream side in the X axis direction in a projection space in the Z axis direction, which projects to the distributing plate side of the opening portion closer to the edge on the downstream side in the X axis direction of the outlet, while approaching the distributing plate from the downstream side in the X axis direction of the projection space.

3. The all primary combustion burner according to claim 2, wherein height in the Z axis direction from the partition plate to a tip of the first baffle plate is 85% to 90% of dimension in the Z axis direction of the first distributing chamber.

4. The all primary combustion burner according to claim 1, wherein a second baffle plate that prevents the air fuel mixture from flowing straight in the X axis direction toward the end on the upstream side in the X axis direction of the first distributing chamber is provided.

5. The all primary combustion burner according to claim 4, wherein the second baffle plate has an inclined plate section that extends to the upstream side in the X axis direction while inclining in the Z axis direction approaching the distributing plate from an edge on the upstream side in the X axis direction of the outlet and a rising section that rises while curving in the Z axis direction from a tip of the inclined plate section to the distributing plate.

6. The all primary combustion burner according to claim 5, wherein a gap width in the Z axis direction between the tip of the rising section of the second baffle plate and the distributing plate is 10% to 15% of the dimension in the Z axis direction of the first distributing chamber.

* * * * *